United States Patent [19]

Megna et al.

[11] 4,184,249

[45] Jan. 22, 1980

[54] SCISSORS-LIKE TOOL

[75] Inventors: Salvatori G. Megna, Sacramento, Calif.; Günther Pracht, Solingen, Fed. Rep. of Germany

[73] Assignee: "Jaguar" Stahlwaren Vertriebsgesellschaft mbH & Co. Kommanditgesellschaft, Solingen, Fed. Rep. of Germany

[21] Appl. No.: 939,019

[22] Filed: Sep. 1, 1978

[30] Foreign Application Priority Data

Mar. 16, 1978 [DE] Fed. Rep. of Germany ..... 2811398

[51] Int. Cl.[2] ..... B26B 13/20

[52] U.S. Cl. ..... 30/341

[58] Field of Search ..... 30/254, 260, 341

[56] References Cited

U.S. PATENT DOCUMENTS

| | | | |
|---|---|---|---|
| 242,000 | 5/1881 | Klaucke | 30/341 |
| 430,677 | 6/1890 | Pearsall | 30/341 |
| 590,330 | 9/1897 | Nolen | 30/341 X |
| 923,734 | 6/1909 | Tindall | 30/341 |
| 2,640,264 | 6/1953 | Sullivan | 30/341 |
| 3,906,630 | 9/1975 | Megna | 30/341 |
| 3,974,563 | 8/1976 | Koch | 30/341 |

*Primary Examiner*—Jimmy C. Peters

*Attorney, Agent, or Firm*—John C. Smith, Jr.

[57] ABSTRACT

A scissors-like tool, in particular a hairdressers', household or tailors' scissors, comprises a movable scissors blade pivotally connected to a stationary scissors blade with a finger bow disposed on the respective stock portions of the blades. At least the finger bow provided at the movable scissors blade is made per se of a resilient synthetic material or similar material, inserted into an outwardly directed fork opening of a fork arranged at the rearward end of the said blade, and mounted easily rotatable in an arcuate groove at the inner side of the fork.

4 Claims, 11 Drawing Figures

SCISSORS-LIKE TOOL

BACKGROUND OF THE INVENTION

This invention relates to a scissors-like tool, in particular a hairdressers', householding or tailor' scissors, which comprises finger bows of which the finger bow specifically provided at the movable scissors blade and made per se of a resilient synthetic or similar material is inserted into an outwardly directed fork opening of a fork arranged at the rearward end of the movable scissors blade.

Such scissors are known from U.S. Pat. No. 3,974,563. They have a material disadvantage as do such scissors wherein the bow provided for the thumb is integral with the stock portion of the movable scissors blade, which disadvantage is thus: When opening and closing the scissors, in particular the thumb of the human hand as a result of the relative movement between it and the associated bow of the scissors and the sliding friction occurring is exposed to a thrust stress which has an adverse affect in particular when extensively using the scissors.

SUMMARY OF THE INVENTION

An object of the invention therefore is to arrange the bow of a scissors made per se and provided for receiving in the particular the thumb of one hand, at the movable scissors blade in such a way that the thrust strains on the thumb occurring when opening and closing the scissors are reduced to a minimum.

According to the invention, it is provided for that the bow at least of the movable scissors blade is mounted easily rotatable in an arcuate groove at the inner side of its fork.

The bow as a result of its rotary mounting follows the movements of the thumb upon opening and closing. Thereby, there no longer occurs a relative movement between thumb and bow. The thumb rather engages the inner wall of the bow in an unalterable position, namely only with the work pressure required for opening and closing the scissors. The bow consisting of resilient synthetic or similar material is snapped into the fork opening or into the groove of the fork. There of course also is the possibility of making the fork of resilient material, the fork prongs being able to be expanded to such an extent that a bow made of rigid material is able to be inserted into the fork opening or into the groove of the fork.

An advantageous embodiment of the invention is one in which the bow externally is formed with a spherical surface and is mounted with this spherical surface easily rotatable and pivotable in a complementary spherical bearing at the inner side of the fork. The bow preferably has projections serving as abutments by means of which it secludes the fork therebetween.

It is thereby achieved that the bow is not only rotatable for reducing the thrust strains on the thumb upon opening and closing the scissors, but also is freely pivotable all about in an angular range limited by the abutments. The pivotability all about is advantageous in the following aspects: The thumb of the one hand with which the scissors is operated, inserted into the bow, when opening and closing a conventional scissors as a result of its inclined position in the bow substantially rests on the one edge of the inner surface of the bow, namely to the major part with its back which is far more pressure-sensitive as compared with the inner surface.

The consequence of this are strains which are counteracted up to now, as can for instance be taken from the U.S. Pat. No. 923,734, by a lining of the inner surface of the bow consisting of resilient material. With the scissors according to the invention, on the other hand, the bow as a result of its pivotability all about when pushing through the thumb snugly engages it. Thereby, the thumb does not engage the edge of the bow, and therefore, no strains result when manipulating the scissors. The assembly of the bow may likewise be effected by snapping the bow into the fork opening or into the spherical bearing.

The U.S. Pat. No. 3,906,630 does already disclose scissors wherein the stock of the movable scissors blade is made in two pieces and the bow which is guided with the stock portion provided thereat on the other stock portion is freely pivotable thereabout in a limited angular range. The bow is however not at the same time also rotatable in contradistinction to the scissors-like tool according to the invention.

Regarding the rotatable and at the same time universally pivotable arrangement of the bow, another advantageous embodiment of the invention is one in which the bow has a spherical head at the outer circumference with which head it is mounted in a cup provided at the inner side of the fork and that the fork has an arcuate groove at the inner surface in which the bow is guided with clearance.

In this embodiment of the invention, the bow is likewise easily rotatable and universally pivotable in a specific angular range. It can likewise be snapped into the fork opening or into the cup as well as into the groove.

It of course is within the scope of the invention to mount the rotatable and the rotatable and universally pivotable bow in a closed bow into which it is likewise snappable.

BRIEF DESCRIPTION OF THE DRAWINGS

Embodiments of the invention will now be described by way of example and with reference to the accompanying drawings, in which.

DESCRIPTION OF THE PREFERRED EMBODIMENTS

Figure 1:
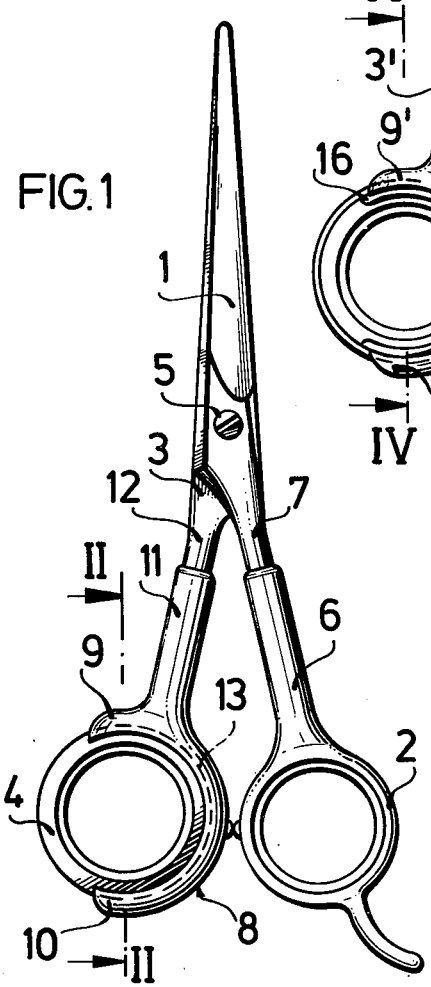
FIG. 1 is an elevational view of a hairdressers' scissors according to the invention.
Figure 3:
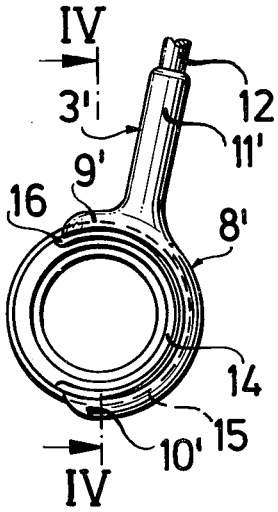
FIG. 3 is an elevational view of the rearward portion of a movable scissors blade according to a second embodiment of the invention.
Figure 4:
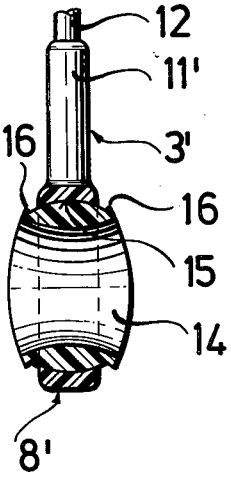
FIG. 4 is a sectional view taken along line IV—IV of FIG. 3.
Figure 5:
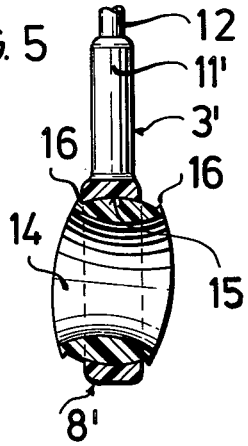
FIG. 5 is the same sectional view as shown in FIG. 4, but with the bow pivoted.
Figure 2:
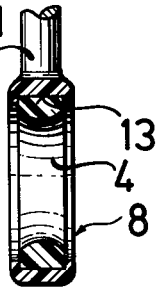
FIG. 2 is a sectional view taken along line II—II of FIG. 1.
Figure 6:
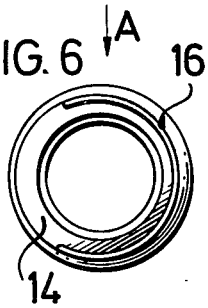
FIG. 6 is an elevational view of the bow.
Figure 7:
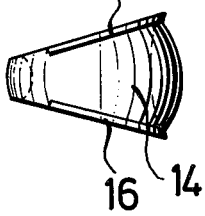
FIG. 7 is the bow as viewed in direction of the arrow A of FIG. 6.

The scissors illustrated in the drawings in FIGS. 1 and 2 comprises a stationary scissors blade 1 with a finger bow 2 and a movable scissors blade 3 with a finger bow 4. The scissors blades 1 and 3 are jointed to one another by a pivot screw 5. The finger bow 2 possesses a hollow-cylindrical shank 6 by means of which it is firmly seated on a stock portion 7 of the scissors blade 1. The finger bow 2 and the hollow-cylindrical shank 6 are made in one piece of synthetic material. The finger bow 4 is made of a resilient synthetic material. The reference numeral 8 designates a fork defined by fork prongs 9, 10 with a fork opening open outwardly. The fork 8 has a hollow-cylindrical shank 11 at its external circumference by means of which shank it is firmly seated on a stock portion 12 of the scissors blade 3. The fork 8 and the shank 11 are made integrally of synthetic material. The fork 8 has an arcuate groove 13 at its inner surface, said groove extending up to the ends of the fork prongs 9 and 10. The finger bow 4 is snapped into the fork opening, i.e. into the groove 13, and freely rotatable therein. The fork prongs 9 and 10 extend over more than half of the peripheral length of the finger bow 4 so that the finger bow 4 is secured in the fork 8.

According to another embodiment of the scissors-like tool of which the movable scissors blade 3' is illustrated partially in FIGS. 3 to 7, the finger bow 14 consisting of resilient synthetic material is formed spherical externally. Furthermore, the fork 8' internally has a spherical bearing 15 which extends to the ends of the fork prongs 9', 10' and in which the finger bow 14 is mounted easily rotatable as well as easily universally pivotable. The finger bow 14 at its external circumference has two opposite arcuate projections 16 by means of which it secludes in between the fork 8' with clearance in such a way that the finger bow 14 is only pivotable through a limited angular range. The finger bow 14 is inserted into the fork opening in the same way as the finger bow 4 in that it is snapped into the fork opening, i.e. into the bearing 15. As in the embodiment according to FIGS. 1 and 2 a hollow-cylindrical shank 11' is formed integral with the fork 8'.

Figure 8:
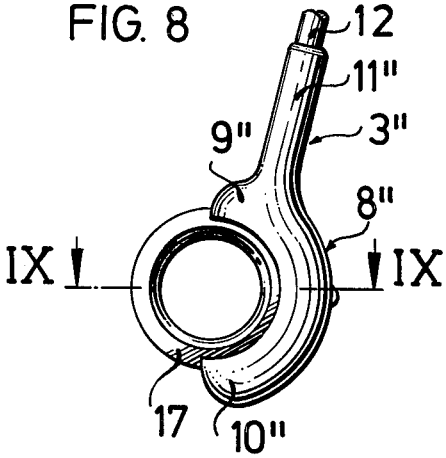
FIG. 8 is an elevational view of the rearward portion of the movable scissors blade according to a third embodiment of the invention.
Figure 10:
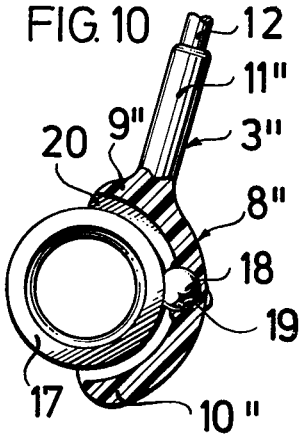
FIG. 10 is a sectional view taken along line X—X of FIG. 9.
Figure 9:
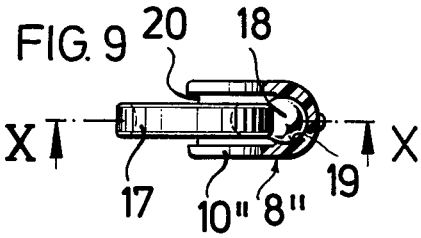
FIG. 9 is a sectional view taken along line IX—IX of FIG. 8.

In the movable scissors blade 3'' according to a further embodiment illustrated partially in FIGS. 8 to 10, the finger bow 17 consisting of resilient synthetic material at the external circumference has a spherical head 18 integral with the finger bow 17 by means of which head it is mounted in a cup 19 at the inner surface of the fork 8'' slightly rotatable and universally pivotable. The fork 8'' at the inner circumference possesses an arcuate groove 20 which extends to the ends of the fork prongs 9'', 10'' and into which the finger bow 17 is guided with clearance in such a way that it is movable only in a specific angular range. The finger bow 17 is likewise snapped into the cup 19 and into the groove 20.

Figure 11:
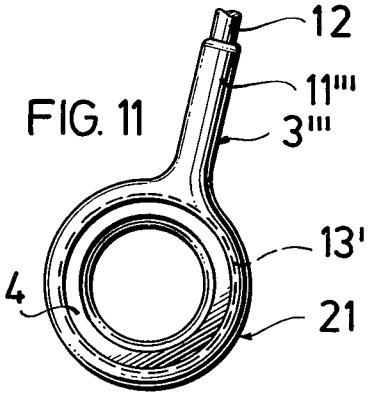
FIG. 11 is an elevational view of the rearward portion of the movable scissors blade with a closed eye serving to mount the finger bow.

The movable scissors blade 3''' illustrated in FIG. 11 in part instead of a fork has a closed eye 21 which internally is provided with a circular groove 13' in which the finger bow 4 is mounted freely rotatable. The finger bow 4 may be snapped into the eye 21 in the same way as into the fork 8.

It is of course within the scope of the invention to arrange the finger bow 2 of the stationary scissors blade 1 likewise rotatable as well as rotatable and universally pivotable.

The invention may be embodied in other specific forms without departing from the spirit or the essential characteristics thereof. The embodiments are therefore to be considered in all respects as illustrative and not restrictive.

We claim:

1. A scissors-like tool, in particular a hairdressers', householding or tailors' scissors, including a movable scissors blade, a stationary scissors blade pivotally connected thereto, and finger bows made of resilient synthetic material or the like arranged in outwardly directed fork openings at the rearward end of the scissors, comprising (a) a movable scissors blade (3,3',3'') pivotally connected to a stationary scissors blade (1) with a finger bow (4,14;17;2) made of resilient synthetic material or the like and fitted through the intermediary of a hollow cylinder shank (11,11',11'';6) to the respective stock portions (12;7) of the blades to form handles for the scissors, and (b) a fork (8,8',8'') having prongs (9,10;9',10';9'',10'') defining an outwardly directed fork opening on at least one of said handles for holding one of the finger bows, the finger bow of said one handle being mounted easily rotatable in an arcuate groove (13,16,20) at the inner side of said fork.

2. A tool as set forth in claim 1, wherein the finger bow (14) externally is formed with a spherical surface and is mounted with this spherical surface in a complementary spherical bearing (15) at the inner side of the fork (8') easily rotatable and universally pivotable.

3. A tool as set forth in claim 1, wherein the finger bow (17) possesses a spherical head (18) at the external circumference, by means of which head it is mounted in a cup (19) at the inner side of the fork (8''), and wherein the fork has an arcuate groove (20) at the inner side in which groove the finger bow (17) is guided with clearance.

4. A tool as set forth in claim 2, wherein the finger bow (14) secludes the fork (8') with projections (16) serving as abutments therebetween.

* * * * *